US009209582B2

(12) United States Patent
Kashiwada et al.

(10) Patent No.: US 9,209,582 B2
(45) Date of Patent: Dec. 8, 2015

(54) CONNECTOR

(71) Applicant: Sumitomo Wiring Systems, Ltd., Yokkaichi, Mie (JP)

(72) Inventors: Tomokazu Kashiwada, Yokkaichi (JP); Hiroyuki Matsuoka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/944,931

(22) Filed: Jul. 18, 2013

(65) Prior Publication Data

US 2014/0024266 A1 Jan. 23, 2014

(30) Foreign Application Priority Data

Jul. 20, 2012 (JP) ..... 2012-161667

(51) Int. Cl.

| | |
|---|---|
| ***H01R 24/76*** | (2011.01) |
| ***H01R 13/631*** | (2006.01) |
| ***H01R 13/533*** | (2006.01) |
| *H01R 13/74* | (2006.01) |

(52) U.S. Cl.

CPC ..... *H01R 24/76* (2013.01); *H01R 13/533* (2013.01); *H01R 13/6315* (2013.01); *H01R 13/748* (2013.01)

(58) Field of Classification Search

CPC ... H01R 13/6315; H01R 24/76; H01R 13/533
USPC ..... 439/686, 587, 583, 271, 272, 607.1
See application file for complete search history.

(56) References Cited

U.S. PATENT DOCUMENTS

| | | | | |
|---|---|---|---|---|
| 3,510,963 | A * | 5/1970 | Boal et al. | 434/224 |
| 3,562,696 | A * | 2/1971 | Barnhart et al. | 39/278 |
| 4,580,862 | A * | 4/1986 | Johnson | 439/248 |
| 6,607,393 | B2 * | 8/2003 | Raypole et al. | 439/347 |
| 7,785,127 | B2 * | 8/2010 | Nagamine | 439/347 |
| 8,485,844 | B2 * | 7/2013 | Omae et al. | 439/607.01 |
| 8,777,647 | B2 * | 7/2014 | Buehman et al. | 439/271 |
| 2006/0240716 | A1 | 10/2006 | Kozono et al. | |
| 2012/0040553 | A1 * | 2/2012 | Tashiro | 439/359 |

FOREIGN PATENT DOCUMENTS

| | | |
|---|---|---|
| JP | 2000-2777217 | 10/2000 |

* cited by examiner

*Primary Examiner* — Briggitte R Hammond
(74) *Attorney, Agent, or Firm* — Gerald E. Hespos; Michael J. Porco; Matthew T. Hespos

(57) ABSTRACT

A connector (10) can be fit into a case-side opening (161) of a shield case (160) so that female terminals (52) in the connector (10) can be connected to male terminals (172) in a device-side connector (170) mounted in a back of the case-side opening (161). The connector (10) includes a housing (20) with a fitting (21) at one end that can fit into the case-side opening (161). Stretchable conductors (51) and wires (71) connected to the female terminals (52) are pulled out from the opposite end of the housing (20). A terminal accommodating portion (30) is formed separately from the fitting (21) and accommodates the female terminals (52) inside. The terminal accommodating portion (30) is mounted into the housing (20) loosely movably in a direction intersecting a fitting direction of the fitting (21) into the case-side opening (161) when connecting the male terminals (172) and the female terminals (52).

7 Claims, 21 Drawing Sheets

CONNECTOR

BACKGROUND

1. Field of the Invention

The present invention relates to a connector.

2. Description of the Related Art

Japanese Unexamined Patent Publication No. 2000-277217 discloses a connector that is intended to prevent trouble during connection due to a dimensional accuracy error or the like. The connector has a spring washer arranged between a housing and a bottom plate. A leaf spring of the spring washer is deflected when the connector is connected to a mating connector. Thus, the housing pivots in accordance with the position of the mating connector and causes a male terminal of the mating connector to be connected properly to a female terminal of the connector.

The above-described connector is assembled so that the female terminal is immovable relative to the housing, even if the mounting position of the male terminal of the mating connector is displaced from a proper mounting position. This displacement cannot be absorbed. Thus, the terminals may not be connected properly in connecting the connectors.

The invention was completed in view of the above situation and an object thereof is to properly connect terminals in connecting connectors.

SUMMARY OF THE INVENTION

The invention relates to a connector with at least one conductor-side terminal to be connected to at least one device-side terminal by being fit into at least one case-side opening. The device-side terminal is provided in a device-side connector formed separately from a case of a device that includes the case-side opening and mounted in a back side of the case-side opening. The connector has a housing with a fitting that can fit into the case-side opening, in one end part and from the other end part of which at least one flexible conductor connected to the conductor-side terminal is pulled out. A terminal accommodating portion is formed separately from the fitting and accommodates the conductor-side terminal inside. The terminal accommodating portion is mounted into the housing for loose movement in a direction intersecting a fitting direction of the fitting into the case-side opening when connecting the device-side terminal and the conductor-side terminal.

Accordingly, any mounting tolerance of the device-side connector with respect to the case-side opening can be absorbed. Specifically, the terminal accommodating portion can loosely move relative to the fitting in the direction intersecting the fitting direction in a state where the fitting of the housing is fit in the case-side opening. The conductor-side terminal can be moved in accordance with the position of the device-side terminal and the device-side terminal and the conductor-side terminal can be connected properly.

The terminal accommodating portion may be mounted to the housing to project more forward than the fitting in the fitting direction and may include a projection projecting forward from the fitting in the fitting direction. Additionally, the device-side connector may include a receptacle that can accommodate the projection inside. Accordingly, a fitting operation becomes easier and connection reliability is improved even if the mount position (standby position) of the device-side connector is located behind the case-side opening and in a position where reliable visual confirmation is difficult.

The conductor-side terminal may be a female terminal and the device-side terminal may be a male terminal that cab fit into the conductor-side terminal. Accordingly, the number of operation steps and a space necessary for the fitting operation can be reduced as compared with a conventional bolt tightening type of connecting a conductor-side terminal including a male tab to a device-side terminal (male terminal).

The flexible conductor may extend from the conductor-side terminal toward the other end of the housing and may include a stretchable conductor stretchable in an extending direction thereof. Thus, the impact of vibration and the like transmitted from the flexible conductor to the conductor-side terminal can be absorbed by the stretchable conductor that can restrain the impact of the vibration and the like of the flexible conductor from being exerted from the conductor-side terminal to the device-side terminal. This can prevent a defect in connected parts of the terminals due to vibration and the like from the flexible conductor.

The terminal accommodating portion may be mounted in the fitting and may include at least one retainer for holding the terminal accommodating portion in the fitting. Thus, forward detachment of the terminal accommodating portion can be suppressed.

A loosely movable distance of the terminal accommodating portion may be determined by a dimension of a clearance between the terminal accommodating portion and the retainer. Thus, the terminal accommodating portion may be movable in the clearance.

The housing may be covered by a shield shell made of an electrically conductive plate material.

The conductor-side terminal may be connected to the device-side terminal by a stretchable conductor.

The stretchable conductor and the flexible conductor may be connected by at least one connecting terminal.

The connecting terminal may comprise a bent or L-shaped terminal and an intermediate terminal that are to be fixed to the housing by a fixing member.

A seal may be mountable on the flexible conductor to seal an inner space of the connector.

These and other features and advantages of the invention will become more apparent upon reading the following detailed description of preferred embodiments and accompanying drawings.

DETAILED DESCRIPTION OF THE PREFERRED EMBODIMENTS

Figure 2:
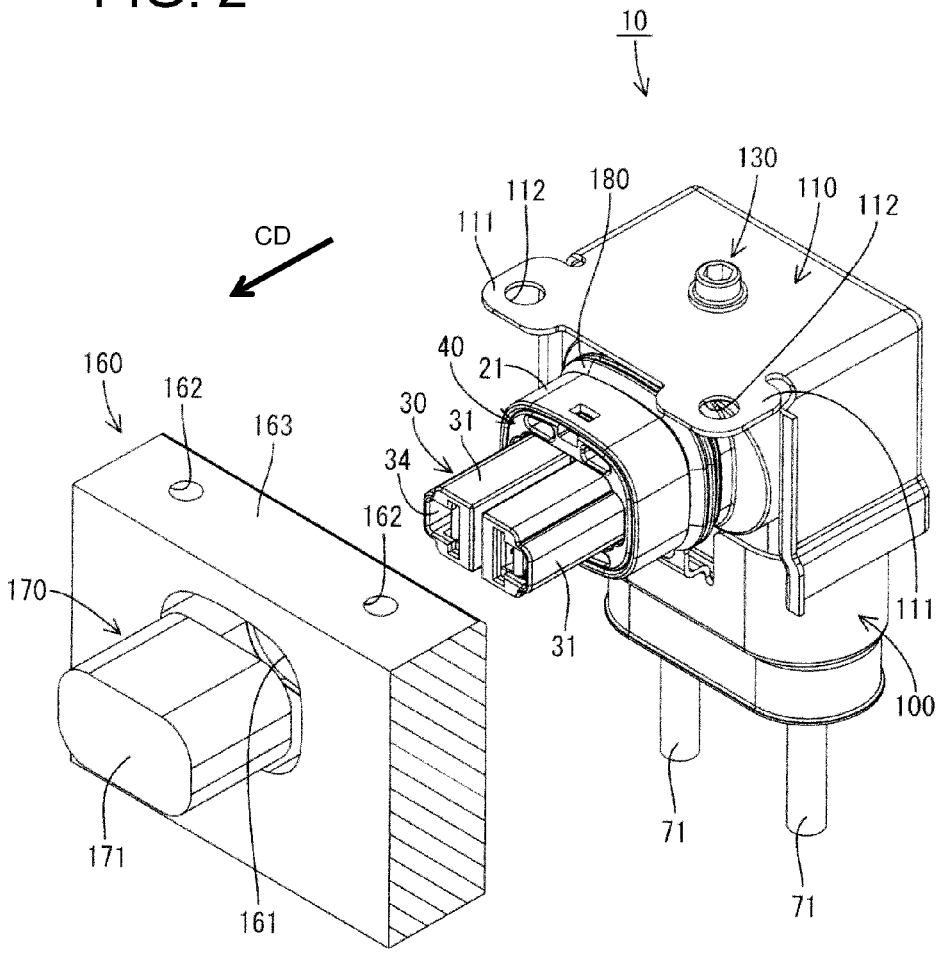
FIG. 2 is a perspective view showing a state before the connector is connected to a device-side connector when viewed obliquely from front.
Figure 3:
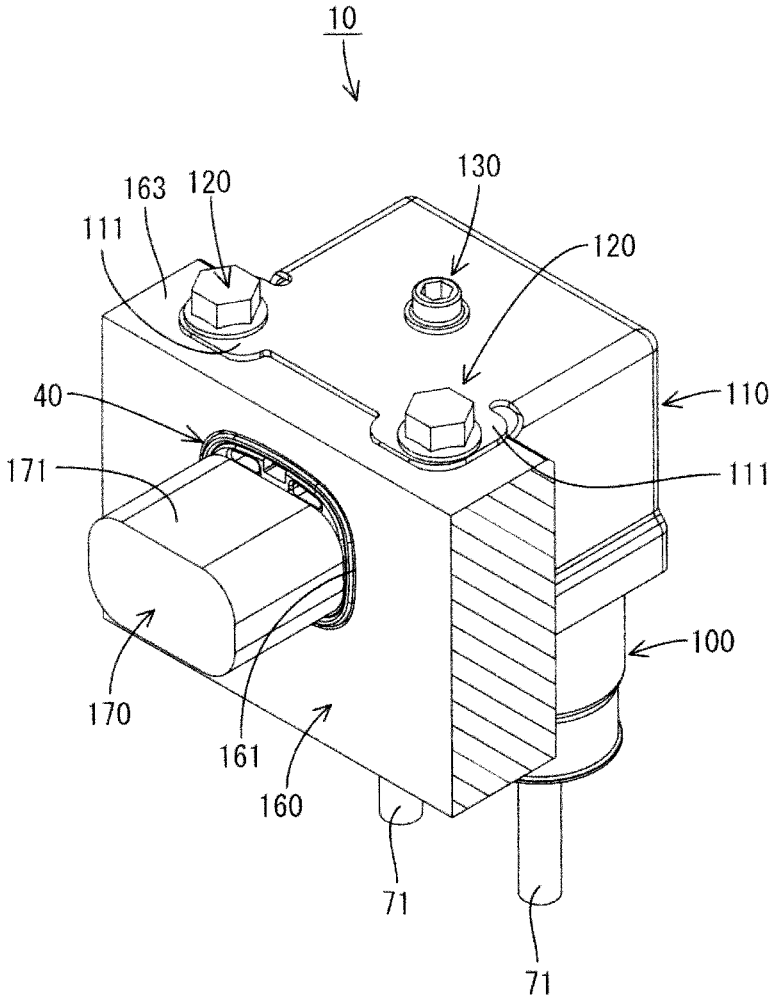
FIG. 3 is a perspective view showing a state after the connector is connected to the device-side connector when viewed obliquely from front.
Figure 4:
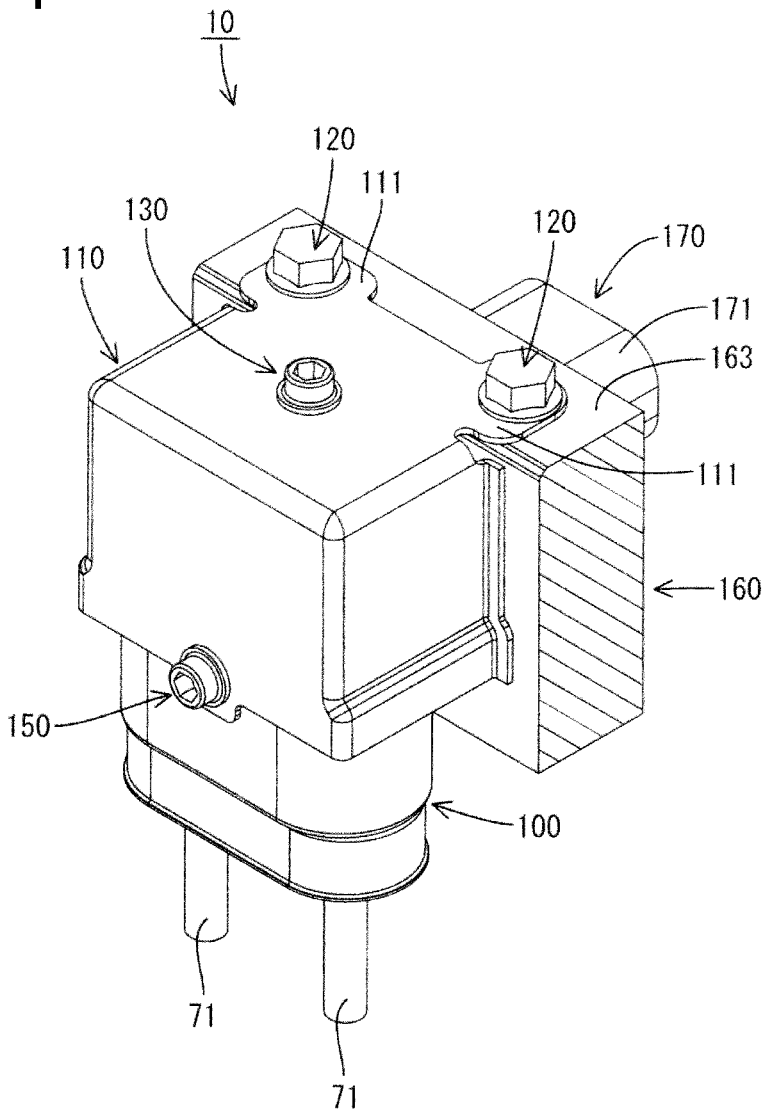
FIG. 4 is a perspective view showing the state after the connector is connected to the device-side connector when viewed obliquely from behind.
Figure 5:
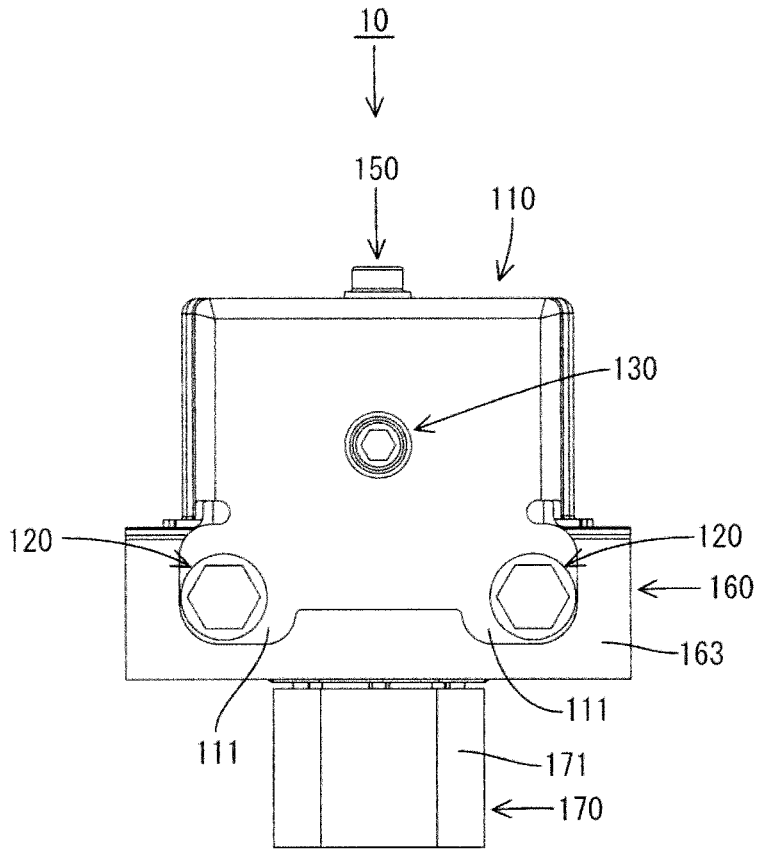
FIG. 5 is a plan view showing the state after the connector is connected to the device-side connector.
Figure 6:
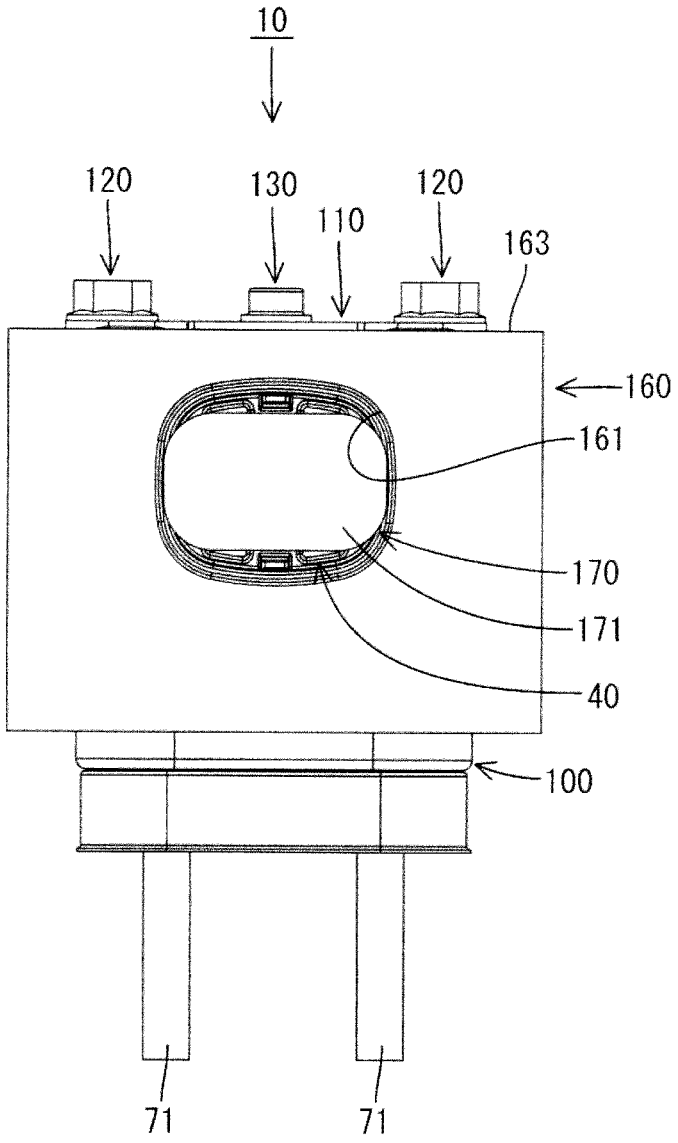
FIG. 6 is a front view showing the state after the connector is connected to the device-side connector.
Figure 10:
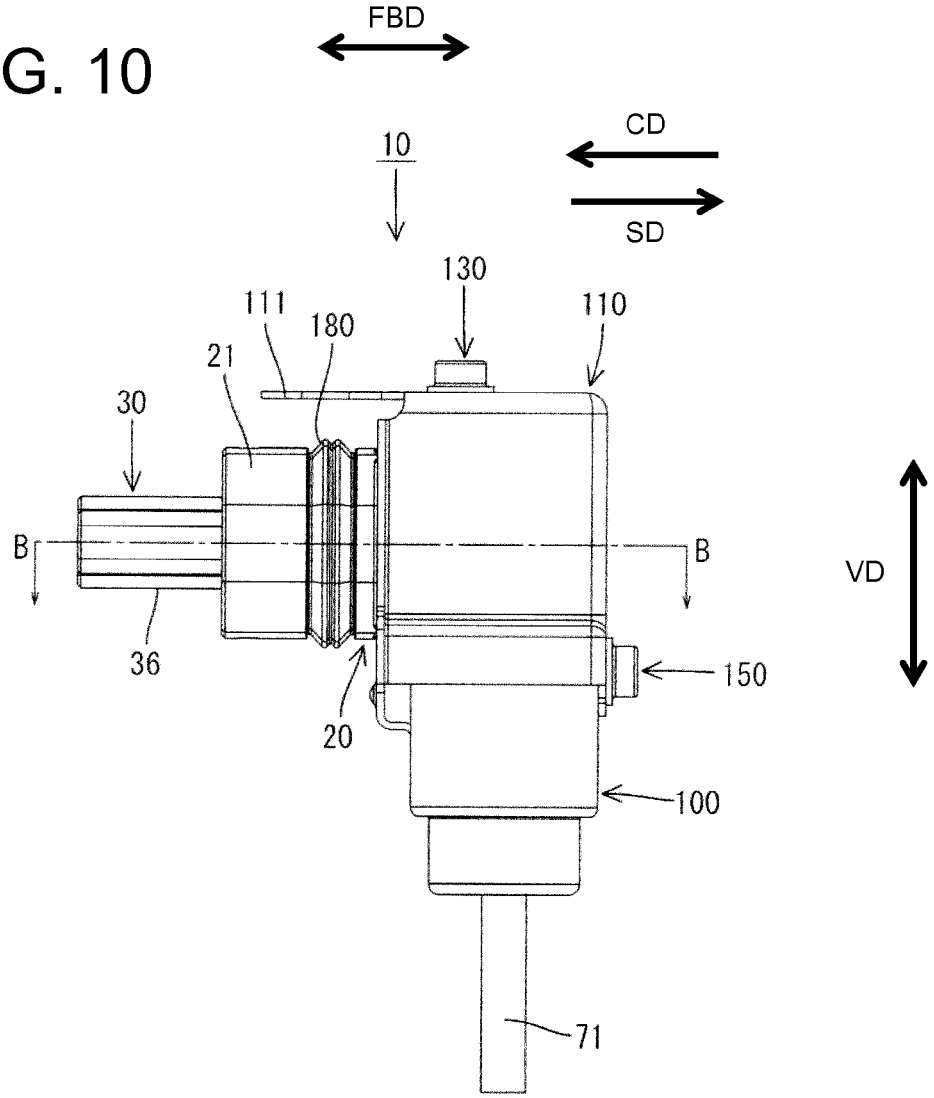
FIG. 10 is a right side view of the connector.
Figure 11:
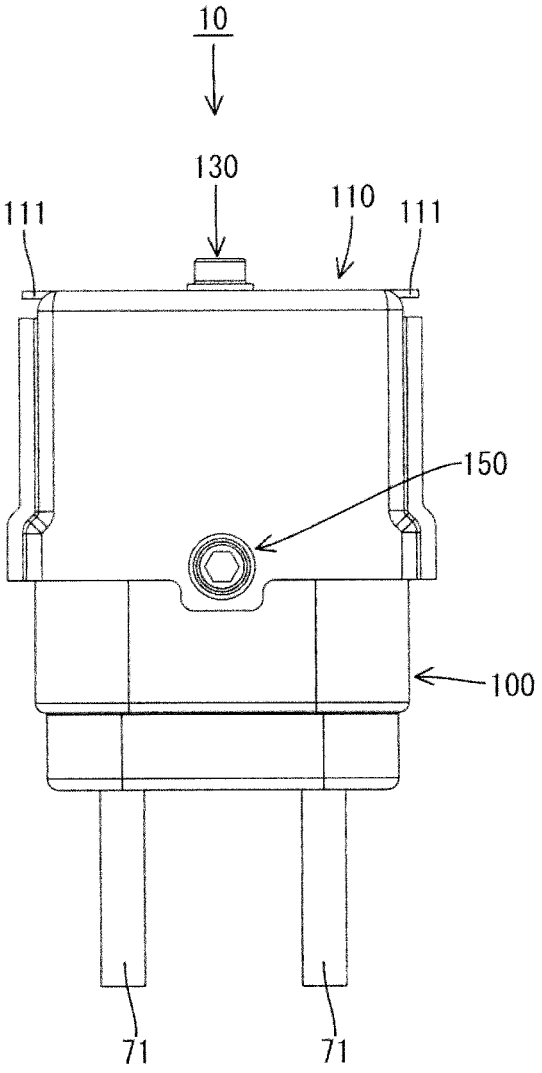
FIG. 11 is a rear view of the connector.
Figure 12:
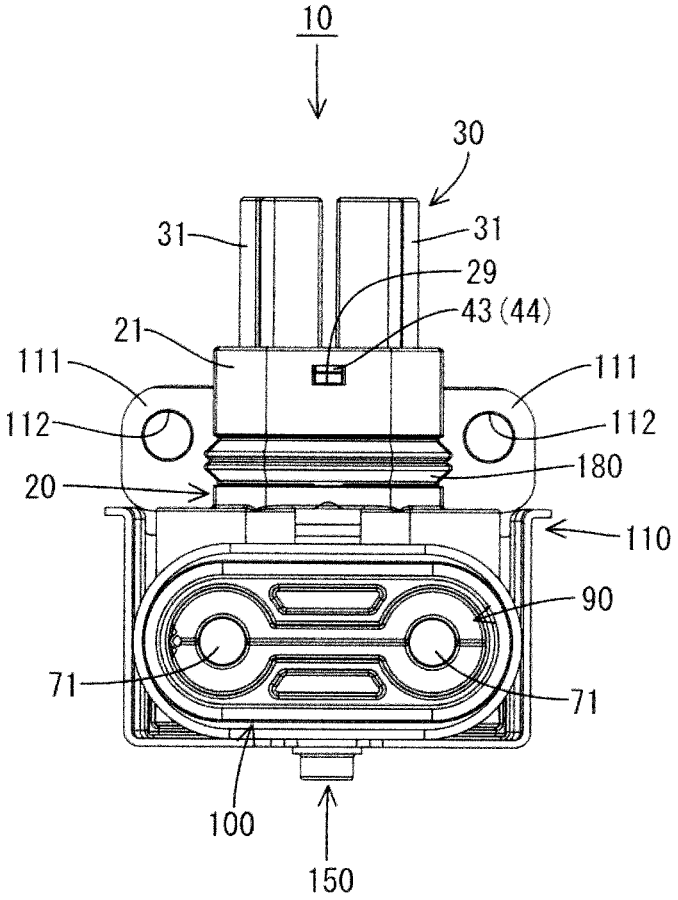
FIG. 12 is a bottom view of the connector.
Figure 13:
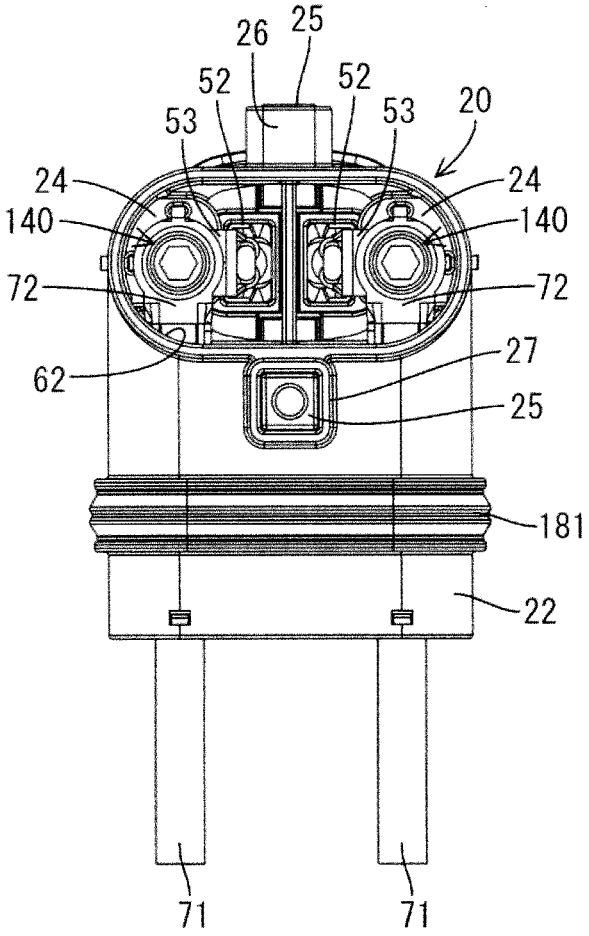
FIG. 13 is a rear view of the connector with a shield shell and a cover removed therefrom.

A connector 10 in accordance with an embodiment of the invention is described with reference to FIGS. 1 to 22. The connector 10 is to be mounted on or to a shield case or shield element 160 of a device, such as an inverter, motor or the like of a vehicle, such as a hybrid vehicle or an electric vehicle. As shown in FIGS. 2 and 3, a device-side connector 170 is arranged in the shield case 160 at a position substantially facing the connector 10 in a connecting direction CD and is connectable to the connector 10. Note that a vertical direction VD is based on that of FIG. 10 in the following description. Further, forward and backward directions FBD are based on lateral directions of FIG. 10, and a leftward direction (connecting direction CD to the device-side connector 170) is referred to as a front direction and a rightward direction (separating direction SD from the device-side connector 170) is referred to as a backward direction.

The device has a device main body (not shown) housed in the shield case 160 made of an electrically conductive material (left front side of the shield case 160 in FIG. 2 is an inner side of the shield case 160). A case-side opening 161 penetrates the shield case 160 in inward and outward directions. Note that only a part of the shield case 160 is shown.

Left and right mounting holes 162 are formed on a horizontal surface 163 on the shield case 160 above the case-side opening 161 and open up, as shown in FIG. 2. An internal thread is formed on the inner peripheral surface of the each mounting hole 162, and mounting bolts 120 can be screwed into the mounting holes 162, as shown in FIG. 3.

Figure 8:
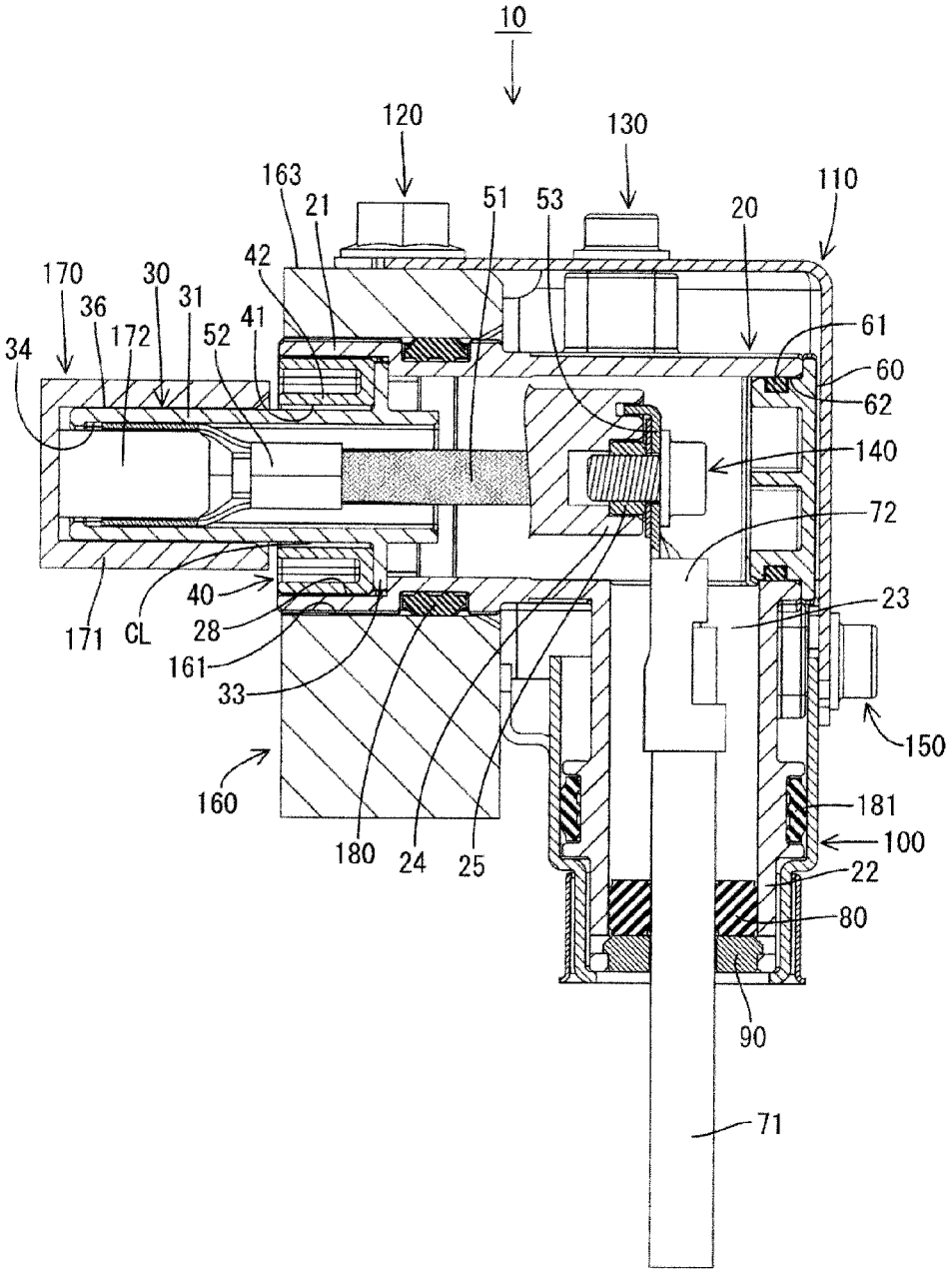
FIG. 8 is a section along A-A of FIG. 7 and a longitudinal section showing a state cut in a longitudinal direction (vertical direction) after the connector is connected to the device-side connector.
Figure 9:
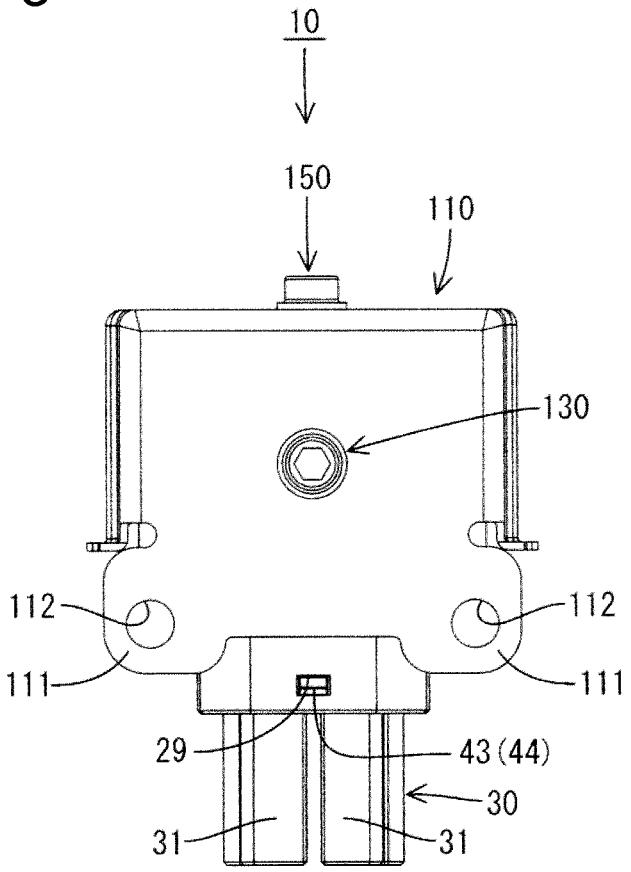
FIG. 9 is a plan view of the connector.

As shown in FIG. 8, the device-side connector 170 has a receptacle 171 made e.g. of synthetic resin, and tab-shaped male terminals 172 project forward from the back wall of the receptacle 171. The receptacle 171 is formed separately from the shield case 160 and is mounted and fixed to the shield case 160 with a specified mounting tolerance.

Figure 1:
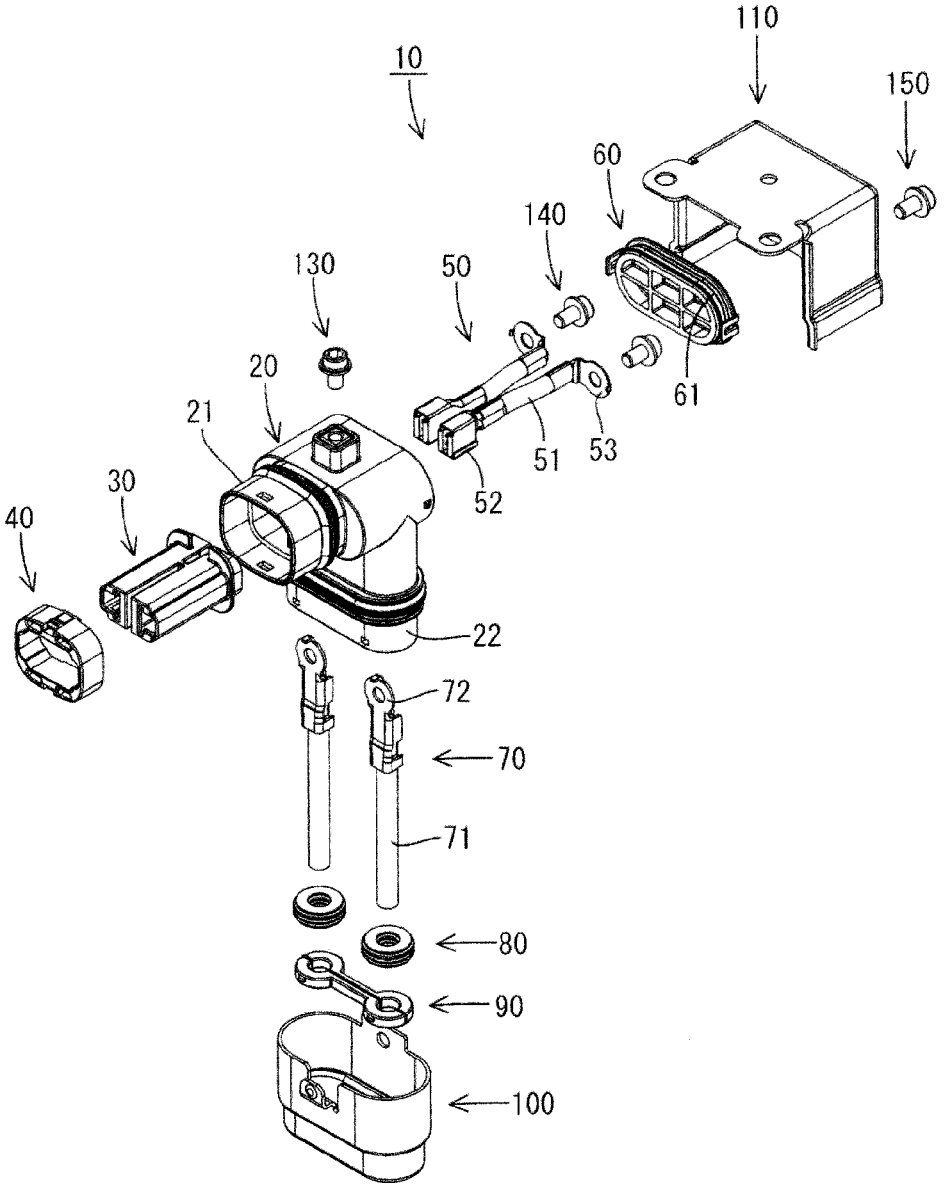
FIG. 1 is an exploded perspective view of a connector.

As shown in FIG. 1, the connector 10 includes a housing 20, a terminal accommodating portion 30, a retainer 40, two inner conductive members 50, a cover 60, two outer conductive members 70, two resilient or rubber plugs 80, a plug presser 90, a lower member 100, an upper member 110, a mounting screw 130 two fixing screws 140 and a coupling screw 150 and the like.

Each inner conductive member 50 has an electrically conductive stretchable conductor 51 formed to be stretchable (or to have a variable axial length) in at least an axial direction. A female terminal 52 is connected to a first end of the stretchable conductor 51, and a substantially L-shaped terminal 53 is connected to a second end of the stretchable conductor 51.

The stretchable conductor 51 is flexible and may be a braided wire formed by braiding thin metal wires made, for example, of aluminum, aluminum alloy, copper, copper alloy or another flexible metal. Copper foils also can be used.

The female terminal 52 has a substantially rectangular tube and a barrel arranged one after the other in forward and backward directions FBD. A resilient contact piece is in the tube and can be brought resiliently into contact with the male terminal 172. The barrel is to be crimped and connected to the stretchable conductor 51. On the other hand, the L-shaped terminal 53 has a substantially round terminal portion and a barrel provided at a right angle to each other. The fixing screw 140 is to be inserted into the terminal portion. The barrel of the L-shaped terminal 53 is to be crimped and connected to the stretchable conductor 51. Although the stretchable conductor 51 is crimped to the female terminal 52 and the terminal 53 in this embodiment, various known connection means can be employed, such as brazing, welding and soldering.

The outer conductive member 70 includes a wire 71 formed by covering a core of metal strands with an insulation coating. An intermediate terminal 72 is connected to the exposed core on an end part of the wire 71. The wire 71 is flexible sufficiently to be deflectable in a direction intersecting the axial direction. On the other hand, the intermediate terminal 72 has a substantially round terminal and a barrel arranged one above the other in the vertical direction VD. The round terminal can receive the fixing screw 140. The barrel is to be crimped and connected to the core of the wire 71. Note that the connection between the wire 71 and the intermediate terminal 72 is not limited to the above crimp connection and may be any one of various other known connection methods such as welding.

The housing 20 is made e.g. of synthetic resin and is substantially L-shaped when viewed sideways. The housing 20 has a fitting 21 and a wire pullout portion 22 at opposite ends, as shown in FIG. 8. The fitting 21 can fit into the case-side opening 161 of the shield case 160. The wires 71 are arranged in the wire pullout portion 22 and are pulled out laterally or down. The wire pullout portion 22 includes two independent accommodation spaces 23 capable of individually accommodating the wires 71. The rubber plugs 80 and the plug presser 90 are accommodated in the wire pullout portion 22.

The plugs 80 are seals made of a resilient material such as rubber for making the respective wires 71 fluid- or watertight, and are sandwiched over substantially the entire circumference between the outer peripheral surface of the respective wire 71 and the wire pullout portion 22. Further, the plug presser 90 is held and retained in the wire pullout portion 22 to hold rubber plugs 80 in the wire pullout portion 22 while sealing the accommodation spaces 23 of the wire pullout portion 22.

The housing 20 has a terminal fixing portion 24 arranged in a substantially right-angled portion that couples the fitting 21 and the wire pullout portion 22, and fixing nuts 25 are press-fit into the terminal fixing portion 24. The round terminal portions of the L-shaped terminals 53 and those of the intermediate terminals 72 are placed on the fixing nuts 25 and the fixing screws 140 are inserted into respective holes and tightened into the fixing nuts 25 so that the L-shaped terminals 53 and the intermediate terminals 72 are connected electrically conductively.

In this way, the intermediate terminals 72 are fixed to the housing 20 and vibration transmitted from the wires 71 are blocked by the housing 20. Even if all the vibration cannot be blocked by the housing 20, the stretchable conductors 51 located before the terminal fixing portion 24 absorb substantially all of the remaining vibration so that contacts of the male terminals 172 and the female terminals 52 are not affected.

As shown in FIG. 8, an operation hole 62 is formed in the housing 20 behind the terminal fixing portion 24. The cover 60 includes a seal ring 61 that closely contacts the inner peripheral surface of the operation hole 62 to seal the interior of the housing 20. As show in FIG. 13, the fixing screws 140 are exposed to outside through the operation hole 62. Thus, the fixing screws 140 can be tightened easily by inserting a tool, such as a hexagonal wrench, through the operation hole 62. The cover 60 then is mounted to the operation hole 62 as shown in FIG. 8, to seal the interior of the housing 20.

The housing 20 is covered by a shield shell made of an electrically conductive plate material, such as aluminum or aluminum alloy, and is formed by assembling the lower member 100 and the upper member 110 with each other. The lower member 100 mainly covers the wire pullout portion 22 and the upper member 110 mainly covers the fitting 21 and the terminal fixing portion 24. Further, the upper member 110 is formed with a mounting portion 111 to be placed on the horizontal surface 163 of the shield case 160. The mounting portion 111 is formed with left and right round mounting holes 112.

Figure 16:
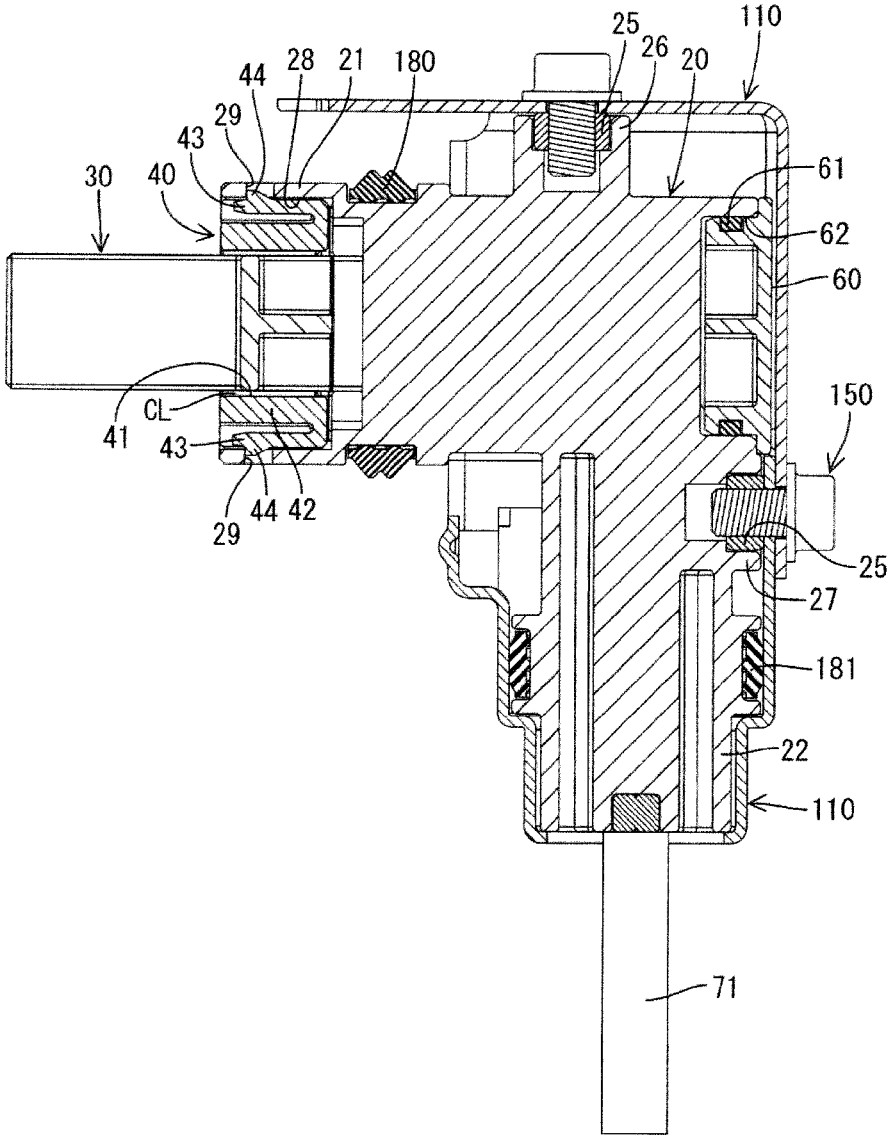
FIG. 16 is a longitudinal section of the connector cut at a position passing through a bolt tightening portion of the shield shell.

As shown in FIG. 16, a shell fixing portion 26 is formed on the outer or upper surface of the housing 20 and a fixing nut 25 is press-fit therein. On the other hand, a shell coupling portion 27 is formed on the rear surface of the housing 20 and a fixing nut 25 is press-fitted therein.

The upper member 110 is to be placed on the shell fixing portion 26 and fixed to the housing 20 by inserting the mounting screw 130 into a screw insertion hole formed substantially in the center of the upper surface of the upper member 110 and tightening the mounting screw 130 into the fixing nut 25. Further, the lower member 100 and the upper member 110 are placed on the shell coupling 27. The coupling screw 150 is inserted into screw insertion holes formed in both members 100, 110 and the members 100, 110 are fastened together to the fixing nut 25. Thus, the members 100, 110 are coupled in an electrically connected state to form the shield shell and are fixed to the housing 20.

Figure 7:
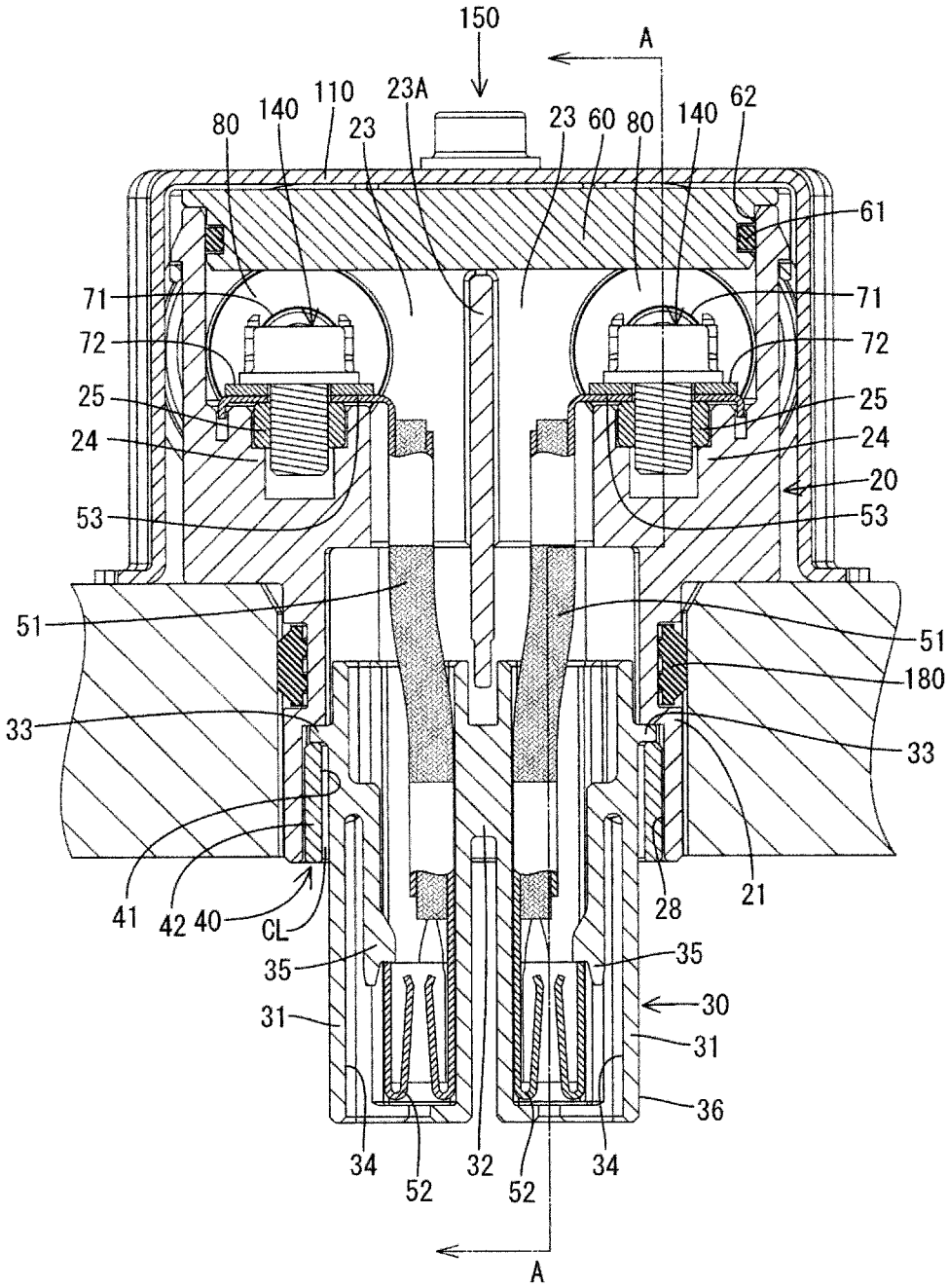
FIG. 7 is a transverse section showing a state cut in a transverse direction (horizontal direction) after the connector is connected to the device-side connector.

A mounting groove is provided around the outer peripheral surface of the wire pullout portion 22 and a seal ring 180 is mounted therein. As shown in FIG. 7, the seal ring 180 is sandwiched over substantially the entire periphery between the bottom surface of the mounting groove and the inner surface of the case-side opening 161 when the fitting 21 is fit into the case-side opening 161. In this way, the interior of the shield case 160 is held in a sealed state.

A mounting groove is provided around the outer peripheral surface of the wire pullout portion 22 and a seal ring 181 is mounted therein. As shown in FIG. 8, the seal ring 181 is sandwiched over substantially the entire periphery between the bottom surface of the mounting groove and the inner surface of the lower member 100 when the lower member 100 of the shield shell is fit externally to the wire pullout portion 22. In this way, the interior of the lower member 100 is held in a sealed state.

Figure 17:
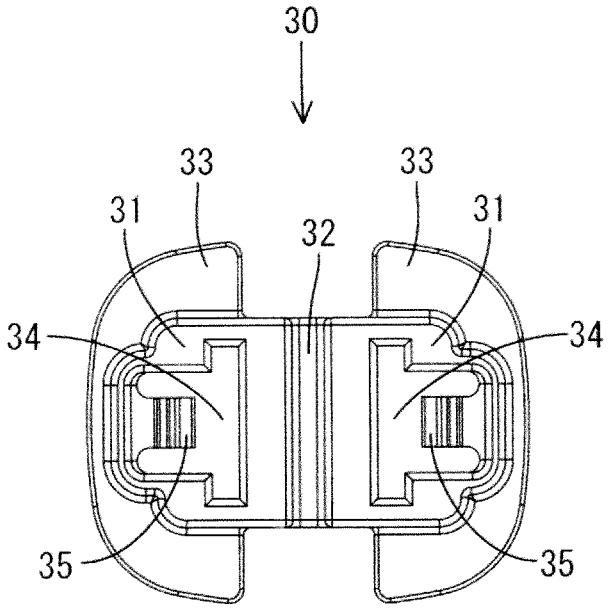
FIG. 17 is a front view of a terminal accommodating portion.
Figure 18:
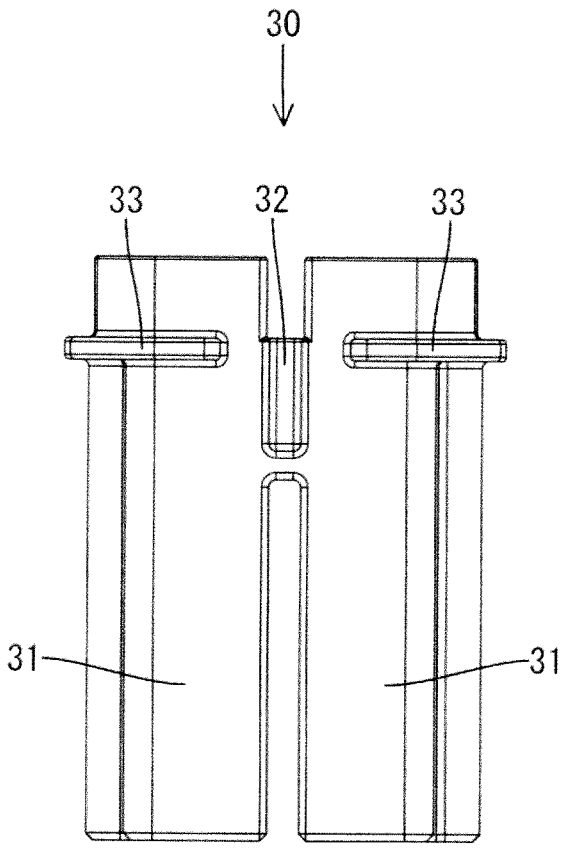
FIG. 18 is a plan view of the terminal accommodating portion.
Figure 19:
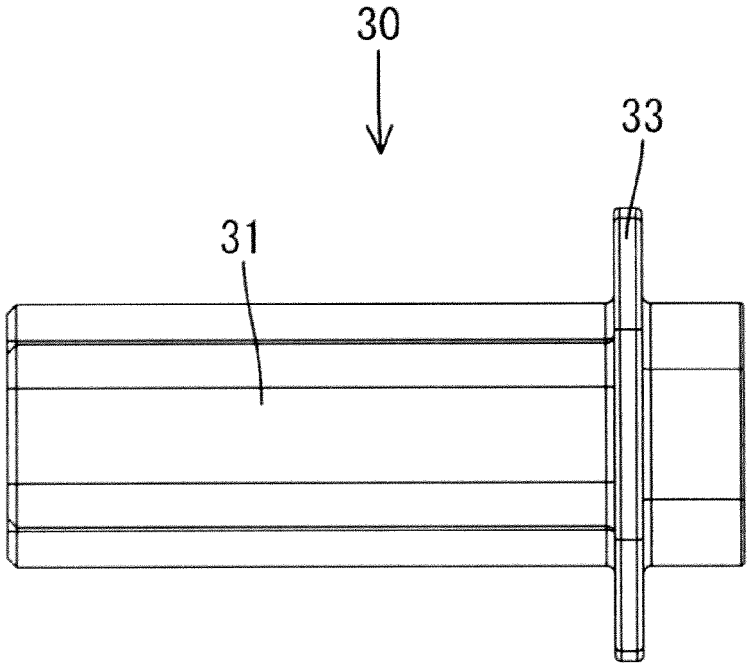
FIG. 19 is a right side view of the terminal accommodating portion.

As shown in FIG. 18, the terminal accommodating portion 30 has two terminal accommodating tubes 31 coupled by a coupling portion 32, and two flanges 33 are formed at positions near the rear ends of the respective terminal accommodating tubes 3. As shown in FIG. 17, the flanges 33 bulge out from left and right sides of the upper and lower surfaces of the terminal accommodating portion 30, excluding widthwise central parts.

Figure 14:
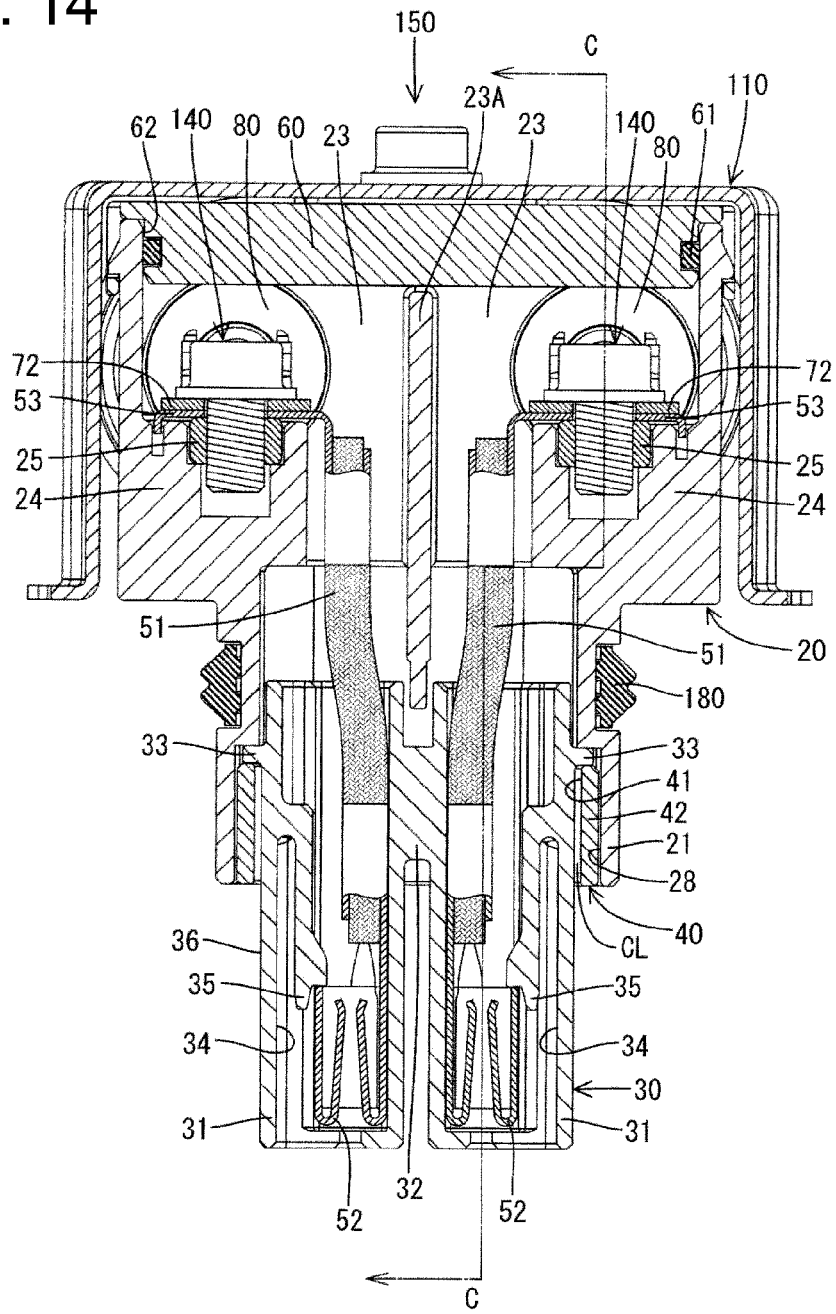
FIG. 14 is a section along B-B of FIG. 10 and a transverse section showing a state of the connector cut in the transverse direction (horizontal direction).

As shown in FIG. 14, cavities 34 are formed in the terminal accommodating tubes 31 for accommodating the female terminals 52 and locking lances 35 are formed on inner walls of the cavities 34 for retaining the female terminals 52. The locking lances 35 are formed on the inner walls at sides distant from the coupling 32 and face each other.

A mounting recess 28 is formed in the fitting 21 before the seal ring 180 and can receive the respective flanges 33 from the front. The flanges 33 contact a rear end part of the mounting recess 28 when the terminal accommodating portion 30 is inserted into the mounting recess 28 from the front to prevent any further backward movement. At this time, the retainer 40 is mountable before the flanges 33 in the mounting recess 28.

Figure 20:
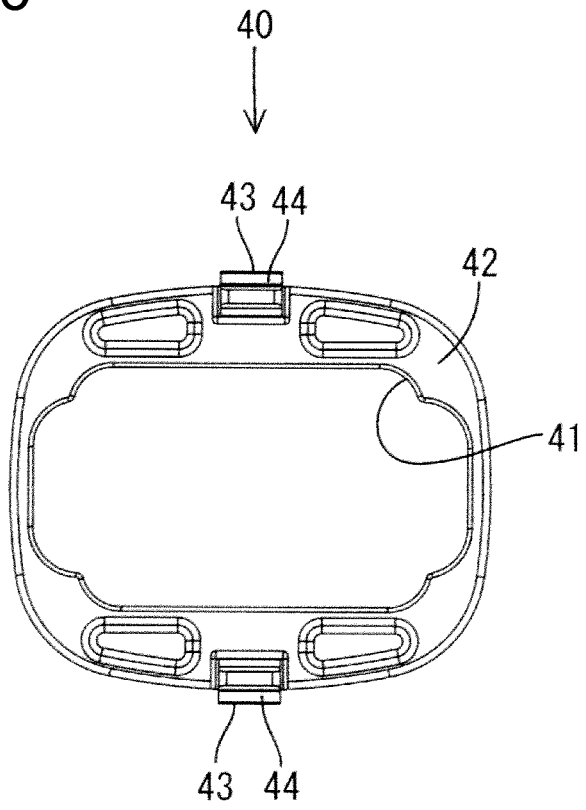
FIG. 20 is a front view of a retainer.
Figure 21:
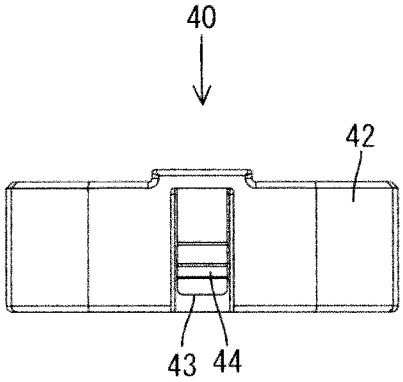
FIG. 21 is a plan view of the retainer.
Figure 22:
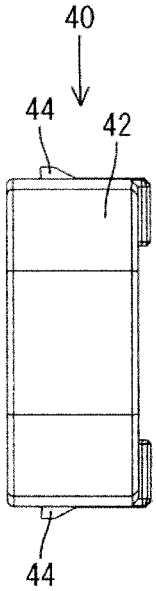
FIG. 22 is a right side view of the retainer.

As shown in FIG. 20, the retainer 40 includes an insertion hole 41 allowing the insertion of the terminal accommodating portion 30. A holding tube 42 is formed around the insertion hole 41 and locks the flanges 33 from the front to hold the terminal accommodating portion 30 in a retained state and to prevent forward detachment of the terminal accommodating portion 30. Locks 43 are formed at upper and lower sides of the holding tube 42. Each lock 43 includes a locking projection 44 that vertically displaceable. On the other hand, the mounting recess 28 is formed with locking holes 29. The locking projections 44 enter the locking holes 29 from the inner side and engage the inner surfaces of the locking holes 29 in forward and backward directions FBD when the retainer 40 is inserted into the mounting recess 28 from the front. Thus, the retainer 40 and the terminal accommodating portion 30 are held in the mounting recess 28.

The terminal accommodating portion 30 is to be mounted into the fitting 21 of the housing 20 and can move loosely in directions at an angle to a fitting direction in which the fitting 21 is fit into the case-side opening 161 and preferably perpendicular to the fitting direction. This movement can be the lateral direction in FIG. 4 or the vertical direction in FIG. 15, but is not limited to the lateral and vertical directions. A loosely movable distance of the terminal accommodating portion 30 is determined by a dimension of a clearance CL between the terminal accommodating portion 30 and the inner peripheral surface of the insertion hole 41. Specifically, a part of the terminal accommodating portion 30 covered by the insertion hole 41 (parts of the respective terminal accommodating tubes 31 corresponding to the coupling 32) is smaller than the insertion hole 41 of the retainer 40 to form the clearance CL over substantially over the entire periphery around the terminal accommodating portion 30. Thus, the terminal accommodating portion 30 is freely movable within the formation range of the clearance CL.

A conceivable configuration for loosely movably mounting a terminal accommodating portion into a fitting is to provide a flexible piece on the terminal accommodating portion and mount the terminal accommodating portion by engaging the flexible piece with the housing 20. According to such a configuration, the terminal accommodating portion can move loosely relative to the fitting by deflecting the flexible piece. However, a large deflection amount is required to ensure a clearance for allowing loose movements of the terminal accommodating portion and may enlarge the terminal accommodating portion. However, the invention achieves loose movable mounting of the terminal accommodating portion 30 by providing the clearance CL between the inner periphery of the insertion hole 41 of the retainer 40 and the outer periphery of the terminal accommodating portion 30.

The clearance CL merely needs to have a dimension necessary to absorb a tolerance and can be set easily without enlarging the terminal accommodating portion 30, thereby contributing to miniaturization of the connector 10.

Figure 15:
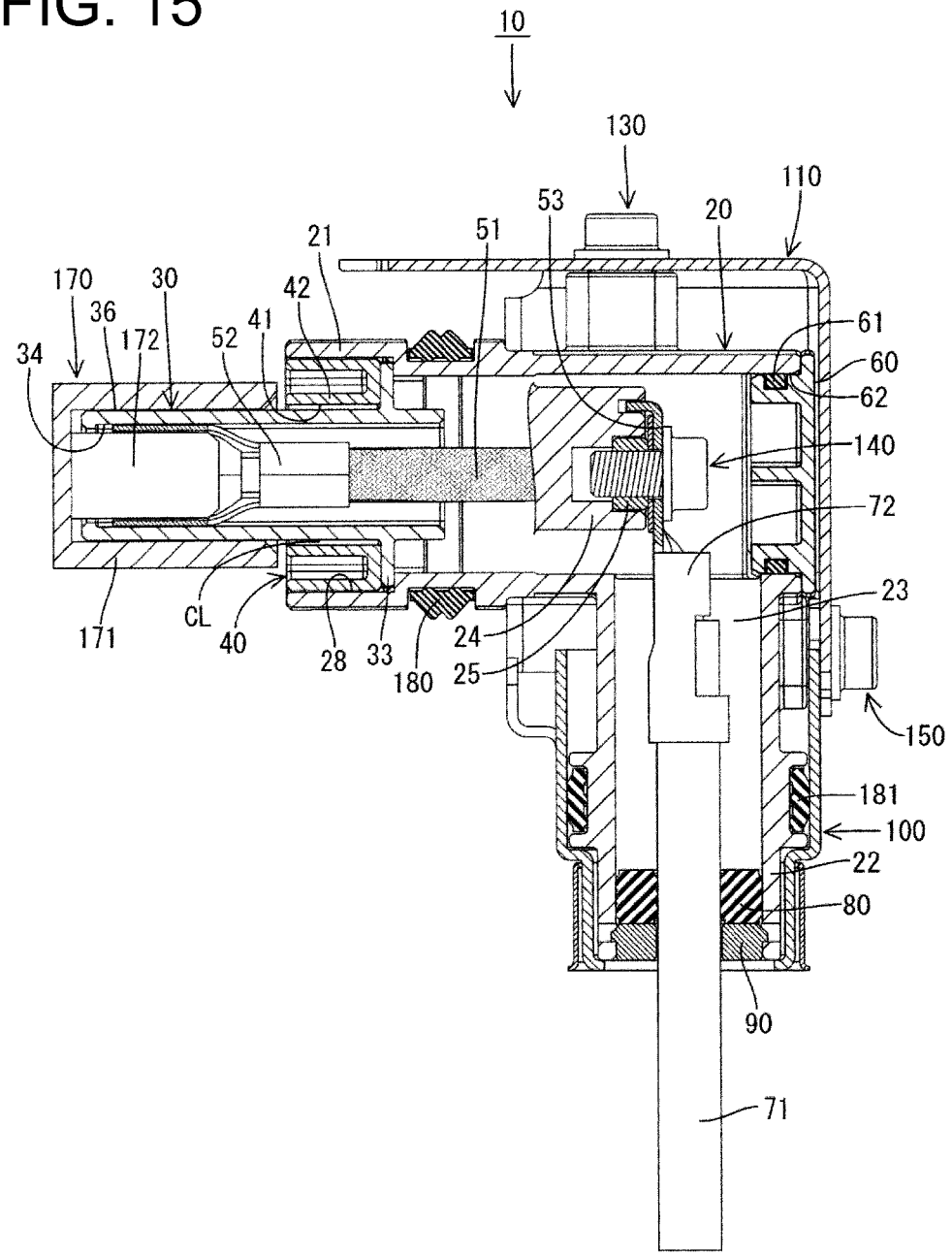
FIG. 15 is a section along C-C of FIG. 14 and a transverse section showing a state of the connector cut in the longitudinal direction (vertical direction).

A projection 36 projects forward from the terminal accommodating portion 30 of the fitting 21 and can be accommodated in the receptacle 171 of the device-side connector 170, as shown in FIGS. 8 and 15. The receptacle 171 may be displaced from a proper mounting position due to a mounting tolerance of the device-side connector 170. However, the terminal accommodating portion 30 moves to the position of the receptacle 171 and the projection 36 can be fit into the receptacle 171. Substantially simultaneously, the male terminals 172 enter the female terminals 52 and the resilient contact pieces contact the male terminals 172. In this way, the terminals 52, 172 can be connected properly by absorbing the mounting tolerance of the device-side connector 170.

The flanges 33 are sandwiched softly in forward and backward directions FBD between the rear surface of the holding tube 42 of the retainer 40 and the rear end of the mounting recess 28 of the fitting 21 so as not to hinder loose movements of the terminal accommodating portion 30. Further, a clearance is formed between the outer periphery of the flanges 33 and the inner surface of the mounting recess 28 and has the same dimension as the above-described clearance CL. This clearance is set so that the flanges 33 remain in contact with the rear end part of the mounting recess 28 even if the terminal accommodating portion 30 is moved loosely to a maximum extent. A partition wall 23A partitions the accommodation spaces 23 of the housing 20 and enters a clearance between the terminal accommodating tubes 31 of the terminal accommodating portion 30 at a position behind the coupling 32, as shown in FIG. 7. This uneven shape provides a large creepage distance (insulating property) between the respective stretchable conductors 51.

The connector 10 is assembled by inserting the wires 71 through the lower member 100. The intermediate terminals 72 then are crimped to ends of the respective wires 71 to form the outer conductive members 70. Further, the female terminals 52 are crimped to one end of each stretchable conductor 51 and the L-shaped terminals 53 are crimped to the other ends to form the inner conductive members 50 (see FIG. 1).

The female terminals 52 then are inserted into the cavities 34 of the terminal accommodating portion 30 from behind. The locking lances 35 resiliently restore and engage the rear ends of the rectangular tubes of the female terminals 52 when the female terminals 5 have been inserted to proper positions in the cavities 342. Subsequently, the round terminal portions of the L-shaped terminals 53 are placed on the terminal fixing portion 24 of the housing 20 and the round terminal portions of the intermediate terminals 72 are placed on the round terminal portions of the L-shaped terminals 53.

Rubber plugs 80 are fit through a lower end opening of the lower member 100 and the plug presser 90 is mounted below the rubber plugs 80 to hold the rubber plugs 80. The fixing screws 140 are inserted into the respective round terminal portions of the terminals 53 and the intermediate terminals 72 through the operation hole 62 and are tightened into the fixing nuts 25 of the terminal fixing portion 24, thereby fixing the L-shaped terminals 53 and the intermediate terminals 72 to the housing 20 (see FIG. 8). The cover 60 then is mounted to close the operation hole 62 and the interior of the housing 20 is sealed by the seal ring 61.

Subsequently, the lower member 100 having the wires 71 inserted therethrough is mounted externally on the wire pull-out portion 22 of the housing 20, and the upper member 110 is mounted from the rear side of the housing 20. Then, the respective members 100, 110 are placed at least partly one over the other on the shell coupling 27 and the coupling screw 150 is tightened into the fixing nut 25 to fix the respective members 100, 110 to the housing 20 (see FIG. 16). In this way, the members 100, 110 are united to form the shield shell and the housing 20 is covered by this shield shell.

The fitting portion 21 of the housing 20 is fit into the case-side opening 161 of the shield case 160. At substantially this time, the device-side connector 170 may be mounted with a specified mounting tolerance with respect to the case-side opening 161. In this case, the fitting 21 is mounted substantially in accordance with the position of the case-side opening 161 and the terminal accommodating portion 30 is mounted in accordance with the position of the receptacle 171 of the device-side connector 170. The terminal accommodating portion 30 is loosely movable relative to the fitting 21 in directions perpendicular to the fitting direction. Thus, the male terminals 172 and the female terminals 52 can be connected properly while the mounting tolerance of the device-side connector 170 is absorbed. Further, the stretchable conductors 51 also are detected freely according to the movement of the terminal accommodating portion 30 so that free movements of the terminal accommodating portion 30 are not hindered.

As described above, a mounting tolerance of the device-side connector 170 with respect to the case-side opening 161 can be absorbed. Specifically, the terminal accommodating portion 30 is loosely movable relative to the fitting 21 in directions substantially perpendicular to the fitting direction when inserting the fitting 21 of the housing 20 in the case-side opening 161. Thus, the female terminals 52 can be moved in accordance with the positions of the male terminals 172 to achieve proper connection.

The terminal accommodating portion 30 may be mounted in the housing 20 to project more forward in the fitting direction than the fitting 21 and has the projection 36 that projects forward from the fitting 21 in the fitting direction. Additionally, the device-side connector 170 may include the receptacle 171 accommodating the projection 36 inside when the terminal accommodating portion 30 is fit into the case-side opening 161. Thus, a fitting operation is easy and connection reliability is improved even if the mounting position (standby position) of the device-side connector 170 is more backward than the case-side opening 161 (reliable visual confirmation during an operation is difficult).

The male terminals 172 are fit into the female terminals 52 by inserting the fitting 21 into the case-side opening 161. Thus, the number of operation steps and a space necessary for the fitting operation are reduced, as compared with a conventional bolt tightening type of connecting conductor-side terminals including a male tab to the male terminals 172.

The stretchable conductors 51 and the wires 71 extend from the female terminals 52 toward the other end of the housing 20 and are stretchable in an extending direction. Thus, the stretchable conductors 51 absorb vibrations transmitted from the wires 71 to the female terminals 52 and restrain the impact of vibration of the wires 71 from being exerted from the female terminals 52 to the male terminals 172. This can prevent a defect in connected parts of the terminals 172, 52 due to vibration from the wires 71.

The terminal accommodating portion 30 may be configured to be mounted into the fitting 21 and includes the retainer 40 for holding the terminal accommodating portion 30 in the fitting 21. According to such a configuration, the terminal accommodating portion 30 can be held mounted in the fitting 21 by the retainer 40 and forward detachment of the terminal accommodating portion 30 can be suppressed.

The invention is not limited to the above described embodiment. For example, the following embodiments also are included in the scope of the invention.

Although the stretchable conductor 51 and the wire 71 are illustrated as a flexible conductor in the above embodiment, the flexible conductor may be formed only by the wire 71 according to the present invention. Further, although the stretchable conductor 51 and the wire 71 are connected by the L-shaped terminal 53 and the intermediate terminal 72, the respective terminals 53, 72 may be omitted and the flexible conductor may be formed only by one wire 71.

The L-shaped terminals 53 and the intermediate terminals 72 are fixed to the housing 20 in the above embodiment. However, these terminals 53, 72 need not be fixed to the housing 20 according to the invention.

The terminal accommodating portion 30 is mounted loosely movably by the presence of the clearance CL formed between the inner surface of the insertion hole 41 of the retainer 40 and the terminal accommodating portion 30 in the above embodiment. However, a flexible piece may be provided on the terminal accommodating portion and the terminal accommodating portion may be loosely moved by deflecting the flexible piece while being mounted by engaging this flexible piece with the housing 20.

The terminal accommodating portion 30 projects from the fitting 21 in the above embodiment. However, the terminal accommodating portion may be mounted so as not to project from the fitting according. Further, the terminal accommodating portion may not necessarily be mounted in the fitting and only has to be mounted in the housing.

The male terminals 172 are provided in the device-side connector 170 in the above embodiment. However, female terminals may be provided in the device-side connector and male terminals may be provided in the connector 10.

The L-shaped terminal 53 and the intermediate terminal 72 are fixed to the housing 20 by the fixing screw 140 in the above embodiment. However, the L-shaped terminal 53 and the intermediate terminal 72 may be not fixed by the fixing screw 140. For example, the terminal 53 and the intermediate terminal 72 may be fixed within a specified range by a locking lance or the like. Even if the terminal 53 and the intermediate terminal 72 are not fixed in this way, movement between the contact parts of the terminals 52, 171 caused by vibration of the wire 71 or the like can be suppressed by arranging the stretchable conductor 51 between the female terminal 52 and the L-shaped terminal 53.

The shapes of the female terminals 52, the bent or L-shaped terminals 53 and/or the intermediate terminals 72 are not limited to those of the above embodiment and terminals having known other shapes can be used.

The shield shell is made of lower and upper members 100 and 110 in the above embodiment, but may be covered by a unitary shield shell.

Although there are two wires 71 in the above embodiment, there is no limitation to this and there may be one, three or more wires.

The L-shaped terminal 53 and the intermediate terminal 72 are fastened together by one fixing screw 140. However, the terminal 53 and the intermediate terminal 72 may be fastened to the housing 20 by different members such as screws, rivets, pins or the like. Further, the lower member 100 and the upper member 110 are fastened together by one coupling screw 150. However, the lower member 100 and the upper member 110 may be fastened to the housing 20 by different members such as screws, rivets, pins or the like.

The connector 10 is on ends of wires to be mounted in a connector to be installed in a device, such as an inverter or a motor of a vehicle in the above embodiment. However, the connector 10 may be on ends of wires to be mounted in some other device.

Although the connector 10 is mounted on the shield case 160 in the above embodiment, the connector 10 may be mounted on a case having no shielding function.

What is claimed is:

1. A connector in which at least one conductor-side terminal to be connected to at least one device-side terminal by being fit into at least one case-side opening is arranged inside, the device-side terminal being provided in a device-side connector formed separately from a case of a device including the case-side opening and mounted in correspondence with the case-side opening, the connector comprising:

a housing having opposite first and second ends, a fitting at the first end of the housing and being fittable into the case-side opening;

at least one flexible and stretchable conductor having first and second ends, the first end being connected to the conductor-side terminal and the second end being connected to an at least one connecting terminal; and a terminal accommodating portion formed separately from the fitting and accommodating the conductor-side terminal inside;

wherein the terminal accommodating portion is mounted to the housing loosely movably in a direction intersecting with a fitting direction of the fitting into the case-side opening when connecting the device-side terminal and the conductor-side terminal.

2. The connector claim 1, wherein the connecting terminal comprises an L-shaped terminal and an intermediate terminal fixed to the housing by a fixing member.

3. The connector of claim 1, wherein the terminal accommodating portion is mounted to the housing to project more forward than the fitting in the fitting direction and includes a projection projecting forward from the fitting in the fitting direction.

4. The connector of claim 1, wherein the terminal accommodating portion is mounted in the fitting and includes at least one retainer for holding the terminal accommodating portion in the fitting.

5. The connector of claim 4, wherein a loosely movable distance of the terminal accommodating portion is determined by a dimension of a clearance formed between the terminal accommodating portion and the retainer so that the terminal accommodating portion is movable within the clearance.

6. The connector of claim 1, wherein the housing is covered at least partly by a shield shell made of an electrically conductive plate material.

7. The connector of claim 1, wherein the conductor-side terminal is a female terminal and the device-side terminal is a male terminal.

* * * * *